United States Patent [19]

Templet

[11] Patent Number: 5,056,825

[45] Date of Patent: Oct. 15, 1991

[54] REFERENCING DEVICE

[75] Inventor: Vicki Templet, Wheaton, Ill.

[73] Assignee: Wallace Computer Services, Inc., Hillside, Ill.

[21] Appl. No.: 506,275

[22] Filed: Apr. 9, 1990

[51] Int. Cl.[5] ..... B42F 21/00

[52] U.S. Cl. ..... 283/36; 281/38; 281/42; 281/20; 283/117

[58] Field of Search ..... 283/117, 36; 281/20, 281/22, 38, 42

[56] References Cited

U.S. PATENT DOCUMENTS

| | | | |
|---|---|---|---|
| 538,706 | 5/1895 | Sexton | 281/20 |
| 2,272,858 | 2/1942 | Werkheiser | 281/38 |
| 2,728,451 | 12/1955 | Leander | 281/20 |
| 4,201,403 | 5/1980 | Turner | 283/36 |
| 4,486,032 | 12/1984 | Leahy | 281/45 |
| 4,798,401 | 1/1989 | Greig | 281/42 |

FOREIGN PATENT DOCUMENTS

| | | | |
|---|---|---|---|
| 12917 | of 1911 | United Kingdom | 281/20 |

OTHER PUBLICATIONS

A Plurality of Plies with Different Colors.

*Primary Examiner*—Frank T. Yost
*Assistant Examiner*—Hwei-Siu Payer
*Attorney, Agent, or Firm*—Tilton, Fallon, Lungmus & Chestnut

[57] ABSTRACT

A referencing device has a corner constructed of two generally rectangular plies and closed along two adjacent sides to receive a larger generally rectangular sheet and with provision on the outer plies for informational indicia.

1 Claim, 1 Drawing Sheet

REFERENCING DEVICE

BACKGROUND AND SUMMARY OF INVENTION

This invention relates to a referencing device and method and, more particularly, to a corner securing device for rectangular sheets and use thereof.

There has been a substantial use of POST-IT notes*. Among the applications are: "File this under _."; "See me on this."; "FYI."; "Route to _, _, _ and return to _"; "Type this"; "Mail this"; "Read this and return"; "For your signature/approval", etc. Often this note is attached to more than one paper. Therefore, one needs not only to use the note but also a paper clip or folder.

*POST-IT is a registered trademark of 3M Company, Saint Paul, Minn.

The instant invention replaces the need for the POST-IT type note and paper clip. A corner device of this invention is made using two glue lines (eliminating the need and cost of the fold). Advantageously, the device of the invention is made of ledger stock or other material providing a suitably high friction coefficient with normal stationary.

Among the advantages of the invention are (1) it conveniently replaces a clip and a POST-IT note; (2) the glue line acts as a flag or tab so that papers can be easily identified when placed in a file or stack of papers —different color stock or printing along the tab are usable to color code papers on ones desk (i.e., a different color for every project, red for rush items, yellow for correspondence, etc.); (3) check-off boxes make it easy for routing, yet there is enough space to write one's own message; (4) the device can be used twice inasmuch as the corner note has two usable sides, for example one side could have check-off boxes and the back could be blank; (5) the device sticks out above and beside the sheet of paper for easy flaging and file folders, in paper stacks and also in ring binders, books or printouts; (6) the device can be placed in one's calendar as an easy way to remind oneself of things to do; and (7) the device can be placed on important catalog pages—making it used to find frequently referenced information.

Other objects and advantages of the invention may be seen in the details of the ensuing specification.

The invention is described in conjunction with an illustrative embodiment in the accompanying drawing, in which, FIG. 1 is a perspective view of the method of employing the invention, illustrating the insertion of a rectangular sheet into the corner device of the invention;

DETAILED DESCRIPTION

Figure 1:
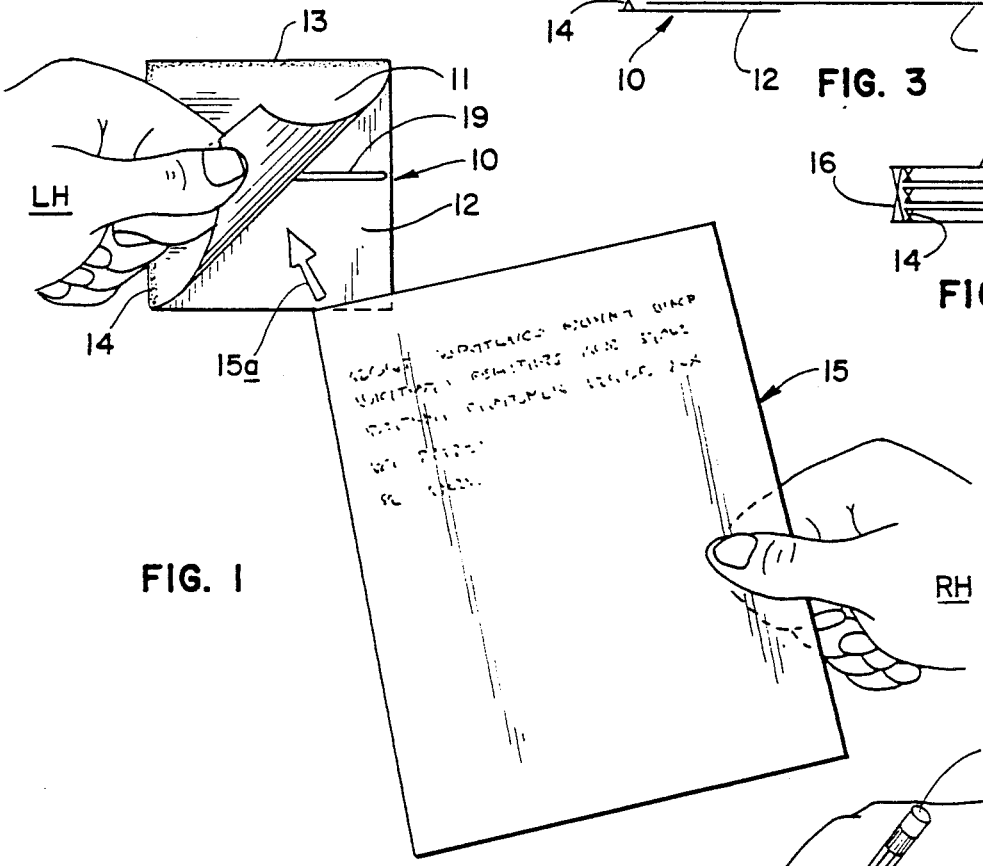

In the illustration given and with reference first to FIG. 1, the numeral 10 designates generally the corner referencing device of the invention and which consists of two plies of paper or like material. The upper ply is designated 11 and the lower ply 12. Each ply is generally rectangular and as can be seen from FIG. 3 the plies are superposed and generally coextensive. Along two adjacent, intersecting sides the plies 11 and 12 are united by lines of glue as at 13 and 14.

Figure 3:
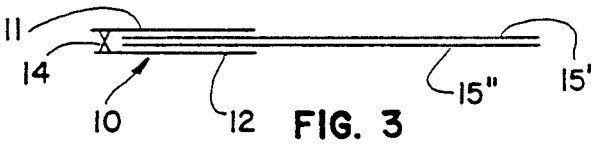
FIG. 3 is a sectional view taken along the sight line 3—3 of FIG. 2.

Still referring to FIG. 1, the numeral 15 designates generally a generally rectangular sheet (as of paper) seen in the process of being inserted into the corner device as indicated by the arrow 15*a*. As indicated previously, a plurality of sheets may be inserted into the pocket developed by opening the corner device 10 and such is illustrated in FIG. 3 as set 15' and 15''.

Figure 5:
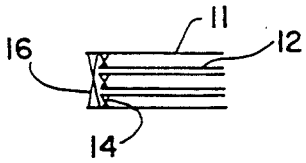
FIG. 5 is an end elevational view of a stack of the corner devices.

Referring to FIG. 5, a pad or stack of devices 10 can be advantageously provided by providing a glue ribbon along one side as at 16 in FIG. 5.

Figure 2:
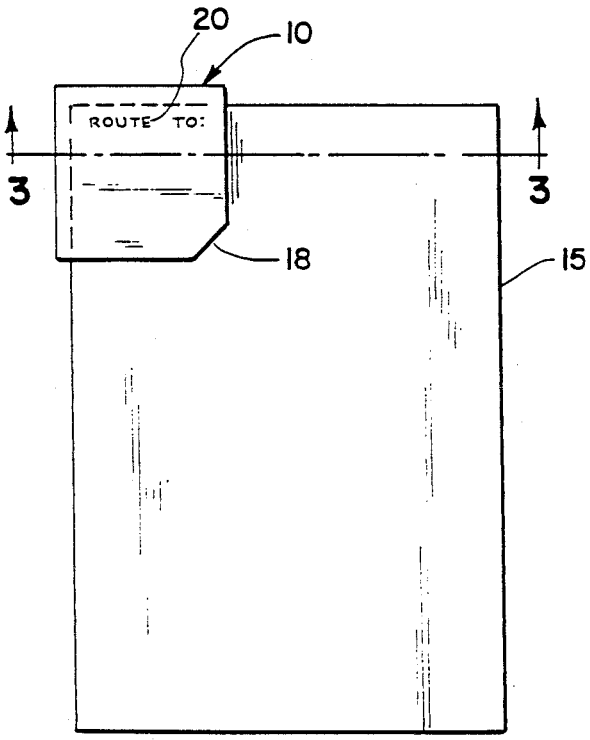
FIG. 2 is a top plan view of the assembly resulting from the operation featured in FIG. 1.
Figure 4:
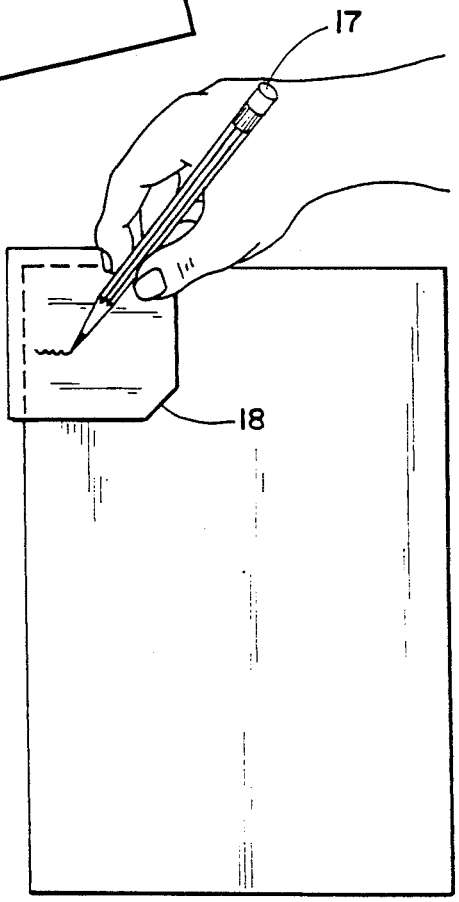
FIG. 4 is a reduced scale perspective view of the assembly of FIG. 2 but featuring an advantageous use of the invention in the form of writing information on the corner device.

An advantageous application of use of the invention is illustrated in FIG. 4 where a writing instrument as at 17 is seen in the process of inscribing written information or instructions on the device 10. Also seen in FIG. 4 (and FIG. 2) is the bias cut as at 18 in the top ply 11 which facilitates opening the device 10 to the configuration seen in FIG. 1.

OPERATION

In the operation or practice of the invention, a pack of pad of devices 10 is advantageously provided in the form seen in FIG. 5. These devices are arranged in superposed, aligned relation with means such as the adhesive band 16 releasably securing the devices in the superposed, aligned relation. Also, different devices in the same or different stacks may be constructed of plies having different colors for purposes such as "Rush", "Correspondence", etc.

When it is desired to capture one or more sheets of correspondence or the like within a given corner device, a device 10 is removed from the stack or other source and conveniently opened by use of the hand LH as seen in the upper left hand portion of FIG. 1. Use of the other hand RH is for the purpose of inserting the sheet of correspondence or the like as at 15 in the direction indicated by the arrow 15*a*.

In some instances, I have found it advantageous to provide friction means as at 19 (see FIG. 1) to augment the capturing of the sheet or sheets 15 within the device 10. The friction providing means may be in the form of a rib which can be developed by deforming a portion of one ply or by laying down a ribbon of rubbery material such as Latex cement which has very little "tack".

The device 10 may be constructed of a variety of materials but those having the weight and gripping power generally of ledger stock.

After the sheet or sheets 15, 15', etc. have been inserted into the device 10, instructions on the further handling may be inscribed as illustrated in FIG. 4. Alternatively or cumulatively routing information may be provided as at 20 (see FIG. 2).

In any event, after the upper surface (as illustrated) of the device 10 has been used for instructional information, the combined device 10 and sheet 15 can be moved, filed, etc. in accordance with visual ascertaining of the information on the corner device.

I claim:

1. A stack of identical, superposed, aligned referencing devices, each device being adapted for mounting on the corner of a rectangular sheet, each device comprising upper and lower generally rectangular plies disposed in face-to-face relation and providing a first pair of substantially straight sides arranged perpendicularly to each other, said plies being adhesively secured together adjacent said two sides to provide a second pair of sides openable to develop a pocket for the receipt of a rectangular sheet, said upper ply being equipped with a biased cut at the intersection of only said second pair of sides, at least a portion of said upper ply being equipped with instructional indicia, and adhesive means releasably securing said devices in superposed, aligned relation along one of said pair of sides.

* * * * *